United States Patent [19]

de Wolf et al.

[11] 4,149,106

[45] Apr. 10, 1979

[54] ELECTRON MULTIPLIER OUTPUT ELECTRON OPTICS

[75] Inventors: David A. de Wolf, Princeton; Carmen A. Catanese, Rocky Hill, both of N.J.

[73] Assignee: RCA Corporation, New York, N.Y.

[21] Appl. No.: 822,670

[22] Filed: Aug. 8, 1977

[51] Int. Cl.² ..... H01J 43/10; H01J 43/18

[52] U.S. Cl. ..... 313/400; 313/105 R

[58] Field of Search ..... 313/105 R, 400, 422

[56] References Cited

U.S. PATENT DOCUMENTS

| | | | |
|---|---|---|---|
| 3,935,500 | 1/1976 | Oess et al. | 313/422 X |
| 4,029,984 | 6/1977 | Endriz | 313/105 R |
| 4,041,342 | 8/1977 | Catanese et al. | 313/105 R |
| 4,051,468 | 9/1977 | Rajchman | 313/400 X |

*Primary Examiner*—Robert Segal

*Attorney, Agent, or Firm*—Eugene M. Whitacre; Donald S. Cohen; George E. Haas

[57] ABSTRACT

An electron multiplier is formed between two spaced parallel substrates of electrically conductive material with a cathode at one end of the substrates. On opposed surfaces of the two substrates are dynodes, extraction electrodes, modulation electrodes, electrically conductive protrusions and deflection electrodes in that order going away from the cathode end. The dynodes form a conventional staggered dynode chain. The modulation electrode on one substrate is opposite a modulation electrode on the other substrate and both have a width equal to the distance between the substrates. The protrusions are similarly directly opposite one another. At the end of the substrates remote from the cathode is a deflection electrode on the tip of each substrate.

10 Claims, 3 Drawing Figures

ELECTRON MULTIPLIER OUTPUT ELECTRON OPTICS

BACKGROUND OF THE INVENTION

The present invention relates to electron multipliers and more particularly to electron optics for controlling the output of said multipliers.

Recently, cathodoluminescent flat panel image display devices have been suggested utilizing a plurality of electron multipliers as sources for the electron beams of the display device. A device of this type is shown in copending U.S. Patent application Ser. No. 709,411 entitled "Apparatus and Method for Modulating a Flat Panel Display Device" filed on July 28, 1976 by J. A. Rajchman, now U.S. Pat. No. 4,051,468 issued Sept. 27, 1977. In these display devices, electrons emitted from one of several cathode stripes on the rear panel of the display are multiplied so as to form an electron beam by an electron multiplier. The cathode stripes address a given line of the display. The output of the electron multiplier is then modulated, focused and accelerated toward a cathodoluminescent screen on the interior of a front wall parallel to the rear wall. These devices use a separate electron multiplier for each picture element on a display line thus requiring a large number of electron multipliers, approximately 1800 for a conventional NTSC television display device.

SUMMARY OF THE INVENTION

An electron multiplier is formed between two spaced parallel substrates of electrically insulative material. A cathode is at one end of the substrates and a plurality of dynodes are on the opposed surfaces of the two substrates. The dynodes on one surface are offset or staggered with respect to the dynodes on the opposed surface of the other substrate. A plurality of parallel extraction electrodes are on the opposed substrate surfaces at the end of the multiplier remote from the cathode. Also on the opposed surfaces of the substrates are two parallel modulation electrodes opposed to one another adjacent to the extraction electrodes and remote from the cathode. The modulation electrodes have a width in the direction normal to the cathode which is approximately equal to the distance between the substrates. On the substrates, adjacent to the modulation electrodes and remote from the cathode are two opposed protrusions having an electrically conductive surface. A pair of deflection electrodes are on the tip of each substrate at the opposite end from the cathode. The deflection electrodes are tapered away from the midpoint between the two substrates so that the distance between the deflection electrodes increases going away from the cathode.

DETAILED DESCRIPTION OF THE PRESENT INVENTION

Figure 1:
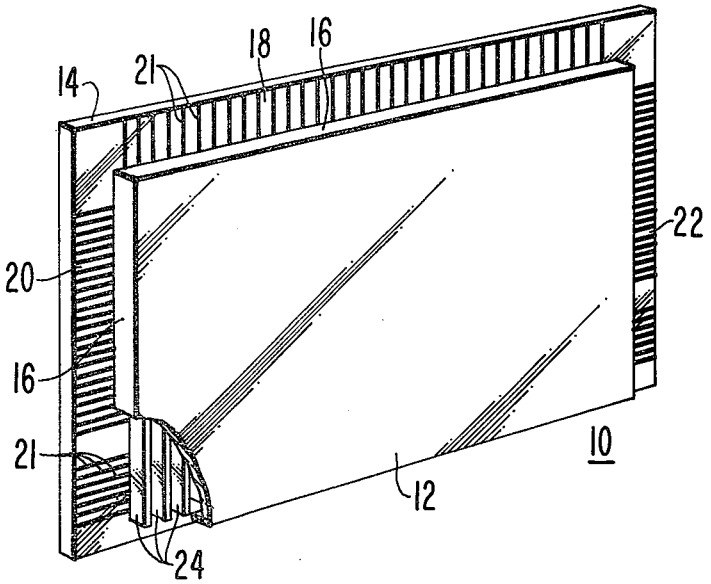
FIG. 1 is a perspective view of a flat panel image display device incorporating the output electron optics of the present invention.

With initial reference to FIG. 1, one form of a flat panel image display device 10 which incorporates the present invention includes an evacuated glass envelope having a flat transparent viewing front panel 12 and a flat back panel 14 in a spaced parallel relation connected by sidewalls 16. The back panel 14 extends beyond the sidewall 16 of the device 10 to form terminal areas 18, 20 and 22. Each of the terminal areas has a plurality of leads 21 which connect to electrodes and other components within the envelope for activating and controlling the display device. In one embodiment the overall dimensions of the device 10 may be 84 cm high by 112 cm wide by 3 cm thick, with a viewing area of 76 cm by 102 cm.

Figure 2:
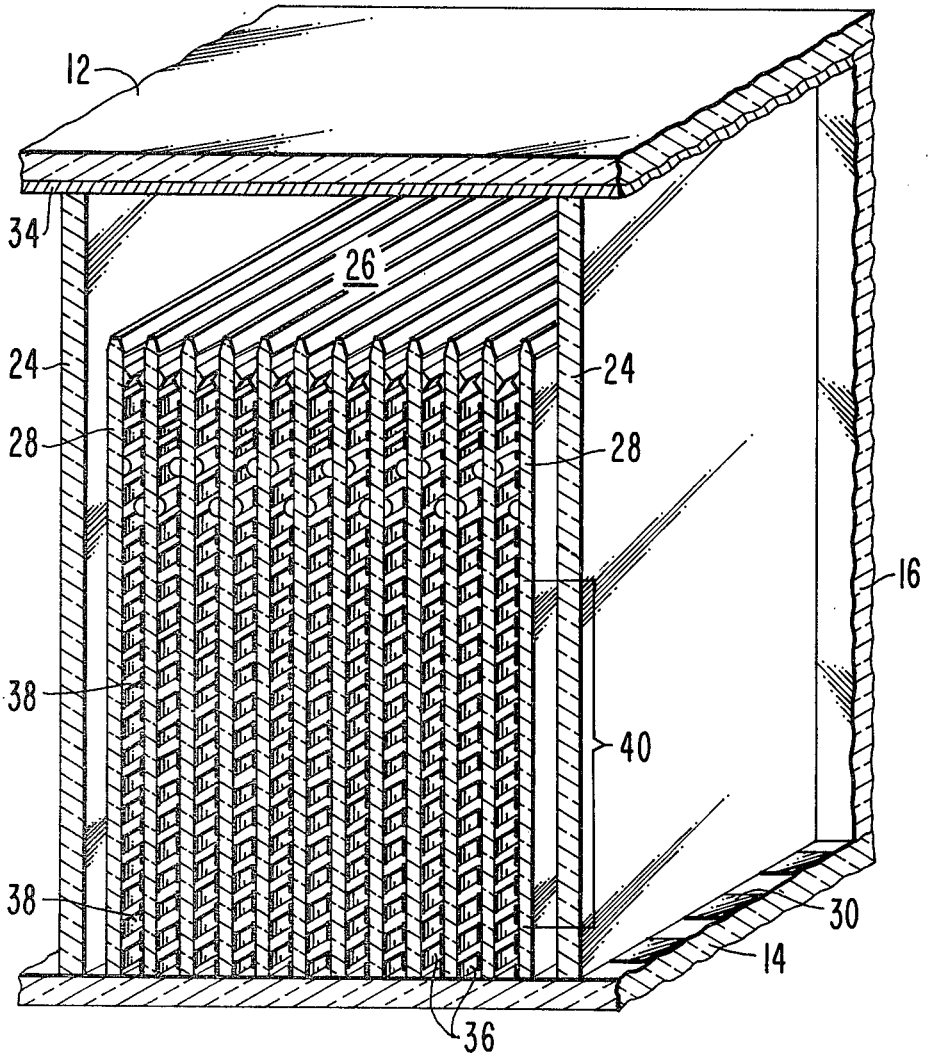
FIG. 2 is a cross-sectional view of the display device in FIG. 1.

Turning our attention to the sectional view of FIG. 2, extending between the front and back panels 12 and 14 are a plurality of internal support walls 24 which provide support of the display device against atmospheric pressure and divide the interior of the envelope into a number of modules 26. The support walls are made of an electrically insulative material such as glass. Within each of the modules 26 are of plurality of electrode vanes 28 extending from the back panel 14 toward the back panel parallel to the support walls 24. A plurality of cathode stripes 30 are on the inner surface of the rear panel 14 extending orthogonally across the support walls 24 and vanes 28. With the exception of the vanes 28 immediately adjacent to the support walls 24, each vane 28 serves as a substrate for a plurality of electrodes on both of its major surfaces. The vanes 28 immediately adjacent to the support walls 24 have electroding only on the major surface which is remote from the immediately adjacent support wall 24. The combination of the cathode stripes 30 and the electrodes on the surface of the vanes 28 form electron beam sources for exciting a cathodoluminescent screen 34 on the interior of the front panel 12. The cathodoluminescent screen 34 may be composed of conventional phosphors used in cathode ray tubes. In a display device 10 for displaying a color image, the cathodoluminescent screen 34 may be composed of alternating stripes of different color light emitting phosphor material which extend the length of the module 26 parallel with respect to the support walls 24 and vanes 28.

The electrodes on each of the vanes extend parallel with respect to the rear panel 14 orthogonally across the cathode stripes 30. The first electrode which is nearest the back panel 14 on each vane is an address electrode 36. A plurality of dynodes 38 are on the vanes 28 adjacent to the address electrodes 36 remote from the cathode stripes 30. The plurality of dynodes 38 are composed of an electron emissive material such as MgO or BeO, and form a conventional electron multiplier 40 between adjacent vanes 28. The dynodes 38 on the surface of one vane 28 are offset normal to the cathode 30 with respect to the dynodes 38 on the opposed surface of the adjacent vane. This staggered relationship forms a conventional dynode chain well known in the electron multiplier art.

Figure 3:
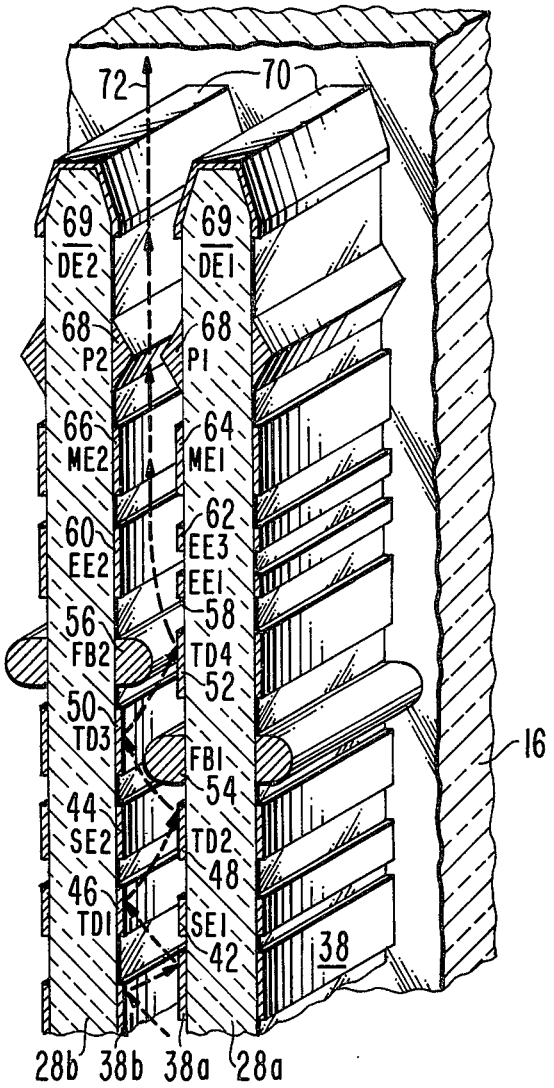
FIG. 3 is an enlarged portion of the sectional view in FIG. 2.

The remaining electrodes on each of the vanes 28 are shown in greater detail in FIG. 3 which represents two adjacent vanes **28*a* and 28*b*. Spaced from and parallel to the last dynodes 38*a* and 38*b* on each of the adjacent vanes 28*a* and 28*b*, are a high energy electron filter bump (fb) 54 or 56, respectively forming a high energy electron filter similar to that disclosed in the copending U.S. Patent application Ser. No. 729,281 entitled "Electron Multiplier with High Energy Electron Filter" filed on Oct. 4, 1976 by C. A. Catanese et al. Each of the filter bumps 54 and 56 extends into the space between adjacent vanes 28a and 28b for slightly more than half of the distance between the two vanes. The two filter bumps 54 and 56 are slightly offset from one another so as to form a path in between for the electron beam 72** to pass.

Associated with the high energy electron filter is a transition region comprising steering electrodes 42 and 44 and transition dynodes 46–52 which are parallel to each other and the dynodes 38. The first steering electrode 42 is positioned on the first vane 28a adjacent to the last dynode 38a of the multiplier. The next electrode on the vane 28a is the second transition dynode 48 which is between the first steering electrode 42 and the first energy filter bump 54 which is also located on the first vane 28. The fourth transition dynode 52 is located on the first vane 28 on the other side of the first filter bump 54 from the second transition dynode 48 and opposite the second filter bump 56. The first transition dynode 46, the second steering electrode 44 and the third transition dynode 50 are on the second vane 28b in that order between the last dynode 38b and the filter bump 56 on the second vane 28b.

Following the fourth transition dynode 52 and the second energy filter bump 56 is an extraction region composed of three parallel extraction electrodes 58–62. The first and third extraction electrodes 58 and 62 are on the first vane 28a immediately beyond the fourth transition dynode 52 going away from the cathode. The second extraction electrode 60 is on the second vane 28b opposite both the first and third extraction electrodes 58 and 62 and has a width in the direction normal to the cathode 30 approximately equal to the distance between the two adjacent vanes 28a and 28b. The next electrodes on the vanes 28 going away from the cathode 30 are two modulation electrodes 64 and 66 directly opposite one another and parallel to the extraction electrodes 60 and 62. Both of the two modulation electrodes 64 and 66 have a width in the directional normal to the cathode approximately equal to the distance between the two adjacent vanes 28a and 28b.

Adjacent to the modulation electrodes 64 and 66 on each of the vanes 28a and 28b remote from the cathode is a triangular protrusion 68. The two protrusions on opposed surfaces of adjacent vanes 28a and 28b are directly opposite from one another and extend parallel to the modulation electrodes 64 and 66. The spacing between the two opposed protrusions 68 is approximately one-half the distance between adjacent vanes 28a and 28b. Each of the protrusions 68 has a width in the direction normal to the cathode 30 approximately equal to the distance between adjacent vanes 28a and 28b. On the ends 69 of each of the vanes 28 remote from the cathode 30 are deflection electrodes 70. The tips or ends of the vanes and the deflection electrodes 70 thereon are tapered away from the midpoint between the two vanes so that the distance between the deflection electrodes 70 increases going away from the cathode 30. The deflection electrodes have a width in the dimension normal to the cathodes a distance approximately equal to the spacing between two adjacent vanes 28.

The following specific dimensions are an example of the spatial relationship of the various output electrodes. The distance between adjacent vanes 28 is about 1 mm. The following table gives the approximate width of the electrodes in the dimension normal to the cathode 30, the approximate spacing between the electrode and the next electrode which is closer to the cathode 30 on the same vane 28, and bias voltages of each electrode.

| Electrode | Width (mm) | Spacing (mm) | Voltage |
|---|---|---|---|
| TD1 | .76 | .71 | −950 |
| TD2 | .76 | .41 | −650 |
| TD3 | .76 | .42 | −250 |
| TD4 | .91 | .51 | 0 |
| SE1 | .44 | .25 | −950 |
| SE2 | .76 | .41 | −650 |
| FB1 | .71 | .36 | −270 |
| FB2 | .71 | .36 | 0 |
| EE1 | .34 | .51 | 250 |
| EE2 | 1.00 | .58 | 250 |
| EE3 | .34 | .34 | 250 |
| ME1 & 2 | 1.00 | .47 | −10 to −100 |
| P1 & 2 | 1.00 | .51 | 250 |
| DE1 & 2 | 1.00 | 1.3 | 800 |
| Anode | | | 7000 |

During the operation of the device, a line of the image to be displayed is selected by properly biasing one of the stripe cathodes 30 on the rear panel 14. The individual picture elements along the line are scanned by addressing the various electron sources between two adjacent vanes 28 by proper biasing of the address electrodes 36. In an addressed multiplier, the electrons emitted by the cathode 30 will be attracted toward the first dynode 38 in the electron multiplier 40. When this occurs, the electrons will be multiplied in the dynode chain of the electron multiplier 40, producing an electron beam 72 at the multiplier output. As shown in FIG. 3, the electron beam emitted by the last dynode 38a in the multiplier 40 travels through the transition region and the electron filter. The potential applied to the high energy filter bumps 54 and 56 is such that any undesirable high energy electrons will impinge upon the surface of the filter bumps and not pass through. This filtering concept is fully described in the aforementioned copending U.S. Patent application Ser. No. 729,281.

The three extraction electrodes 58–62 steer the electrons emitted by the fourth transition dynode 52 into a trajectory which is substantially parallel to and midway between the two vanes 28a and 28b. The biasing of the two modulation electrodes 64 and 66 forms an electrostatic modulator similar to that found in conventional cathode tubes. A variation of the modulation voltage applied to the two modulator electrodes 64 and 66 on the order of 20 to 30 volts is sufficient to control the electron beam transmission from cutoff to optimal transmission. The beam then passes between a electrostatic focusing aperture formed by the triangular protrusions 68. The effect of the aperture between the protrusions 68 clips and focuses the beam collimating it to the desired size. The clipped electrons are trapped on the protrusions 68. As the beam passes between the two deflection electrodes 70 on adjacent vanes, the electrodes are biased with a deflection voltage to direct the beam to one of several phosphor stripes on the cathodoluminescent screen 34 so that one electron beam may excite several different phosphors. This reduces the required number of multipliers to about 500 from the 1800 mentioned earlier.

Optimum control of the electron beam 72 at the multiplier output is related to the electrode of the output electron optics. Specifically, modulation in the present device is best achieved with modulation electrodes 64 which have a width substantially equal to the spacing between adjacent vanes 28. The protrusions 68 have a similar width relationship and form an electrostatic aperture having an optimal opening approximately equal to one-half the intervane spacing. The deflection electrodes also should have a width about equal to the spacing between the vanes.

What we claim is:

1. An electron multiplier comprising:

two spaced parallel substrates of electrically insulative material;

a cathode at one end of the substrate;

a plurality of parallel dynodes on the opposed surfaces of the substrates, the dynodes on one surface being in a staggered relation with respect to the dynodes on the opposed surface of the other substrate;

a plurality of parallel extraction electrodes on the opposed surfaces on the substrate at the end of a plurality of dynodes remote from the cathode;

two opposed parallel modulation electrodes on opposed surfaces of the substrates adjacent to the extraction electrodes and remote from the cathode, the modulation electrodes having a width approximately equal to the distance between the substrates;

two directly opposed protrusions on opposed surfaces of the substrate adjacent and parallel to the modulation electrodes and remote from the cathode, the protrusions having an electrically conductive surface and forming an electrostatic focusing aperture between adjacent substrates; and a pair of deflection electrodes on the end of each substrate remote from the cathode, the deflection electrodes being tapered away from the midpoint between the two substrates so that the distance between the deflection electrodes increases going away from the cathode.

2. The multiplier as in claim 1, further comprising a means for filtering out high energy electrons, said means being between the dynodes and the extraction electrode.

3. The multiplier as in claim 1, wherein the opposed protrusions are triangular in shape and have a width approximately equal to the distance between the two substrates.

4. The device as in claim 3, wherein the distance between the triangular protrusions is approximately equal to ½ the distance between the two adjacent substrates.

5. The device as in claim 3, wherein each deflection electrode extends in the direction normal to the cathode a distance approximately equal to the distance between the two substrates.

6. An image display device comprises:

an evacuated envelope having a front wall, a rear wall, and a plurality of internal support walls extending between and in contact with the front and rear walls;

a cathodoluminescent screen on the interior surface of the front wall;

a plurality of cathodes on the rear wall;

a plurality of substrates between and parallel to the interior support walls extending from the back wall toward the front wall;

a plurality of parallel dynodes on the opposed surfaces of the substrates, the dynodes on one surface being in a staggered relation with respect to the dynodes on the opposed surface of the other substrate;

a plurality of extraction electrodes on the substrates adjacent to the dynodes and remote from the rear wall;

two opposed parallel modulation electrodes on opposed surfaces of two adjacent substrates adjacent to the extraction electrodes remote from the cathode stripes, the modulation electrodes having a width approximately equal to the distance between adjacent substrates;

two directly opposed protrusions on opposed surface of adjacent substrates, the protrusion being adjacent and parallel to the modulation electrodes remote from the cathode and having an electrically conductive surface; and a pair of deflection electrodes on the end of each of the substrates remote from the cathodes in spaced relation to the screen, the deflection electrodes being tapered away from the midpoint between adjacent substrates so that the distance between the deflection electrodes increases going away from the cathodes.

7. The device as in claim 6, further comprising means for filtering out high energy electrons, said means being between the electron multiplier and the extraction electrodes.

8. The device as in claim 6, wherein the protrusions are triangular and have a width approximately equal to the distance between the two substrates.

9. The device as in claim 8, wherein the distance between the opposed protrusions is approximately equal to ½ the distance between the substrates.

10. The device as in claim 6, wherein each of the deflection electrodes has a width approximately equal to the distance between the two substrates.

* * * * *